United States Patent [19]

Kätscher et al.

[11] Patent Number: 4,572,284

[45] Date of Patent: Feb. 25, 1986

[54] TUBE LANE MANIPULATOR, SPRAYING HEAD AND CORRESPONDING SPRAYING METHOD FOR THE HIGH-PRESSURE BLOWDOWN OF HEAT EXCHANGERS

[75] Inventors: Erich Kätscher, Marloffstein; Johannes Stoss, Erlangen; Robert Weber, Uttenreuth; Dieter Zöberlein, Heiligenstadt; Jakob Weber, Baiersdorf-Hagenau; Josef Forster, Erlangen, all of Fed. Rep. of Germany

[73] Assignee: Kraftwerk Union Aktiengesellschaft, Mulheim an der Ruhr, Fed. Rep. of Germany

[21] Appl. No.: 460,859

[22] Filed: Jan. 25, 1983

[30] Foreign Application Priority Data

Jan. 25, 1982 [DE] Fed. Rep. of Germany ..... 3202248

[51] Int. Cl.[4] ..... F28G 15/00

[52] U.S. Cl. ..... 165/95; 15/312 R; 15/316 R; 122/392; 122/405

[58] Field of Search ..... 165/95, 11 A, 76; 122/381, 405, 382, 392, 390; 15/317, 316 A, 312 R, 316 R

[56] References Cited

U.S. PATENT DOCUMENTS 2,112,896 4/1938 Husbaud ..... 165/95
4,174,549 11/1979 Michelson ..... 15/312 R
4,354,294 10/1982 Silver ..... 122/392 X
4,424,769 1/1984 Charamathieu et al. ..... 122/392
4,445,465 5/1984 Byrd et al. ..... 122/382 X

*Primary Examiner*—Sheldon J. Richter
*Attorney, Agent, or Firm*—Herbert L. Lerner; Laurence A. Greenberg

[57] ABSTRACT

Tube lane manipulator for the high-pressure blowdown of heat exchangers having tubes being spaced apart by a given pitch forming tube lanes therebetween with tubes on opposite sides and having closeable servicing openings formed therein providing access to the tube lanes, including a car being insertible into the tube lanes through the servicing openings and being movable therein by remote control, a spraying head being supported on the car and having nozzles with orifices for spraying jets of blowdown water in a given direction into spaces between the tubes, suction lines having suction stubs for pumping off accumulated blowdown water, and extendible and retractible clamping feet disposed on the car for clamping the car to the tubes on at least one side of a tube lane along a clamping plane in conformity with the given tube pitch, the nozzles being positioned in spraying positions of a spraying position sequence by the clamping feet clamping the car, the given spraying direction from the orifices of the nozzles being adjusted to the given tube pitch and the nozzles being spaced from the clamping plane by a distance being adjusted to the given tube pitch for spraying the jets of water into the spaces between the tubes and a method for carrying out a spraying operation.

23 Claims, 8 Drawing Figures

TUBE LANE MANIPULATOR, SPRAYING HEAD AND CORRESPONDING SPRAYING METHOD FOR THE HIGH-PRESSURE BLOWDOWN OF HEAT EXCHANGERS

The invention relates to a tube lane manipulator for the high-pressure blowdown of heat exchangers particularly for the tube sheet area of steam generators of nuclear power stations, wherein the steam generators are provided with tube lanes and with closeable servicing openings such as handholes which provide accessibility to these tube lanes, including a spraying head of the manipulator being insertible into the tube lanes through the servicing openings and being movable and positionable in such a manner that spray jets of the spraying head can be directed into tube grid interspaces, and accumulating blowdown water can be pumped off again through suction lines having suction stubs. The invention relates to an advantageous spraying head for such a tube lane manipulator and to a method for carrying out a spraying process with such a spraying head as well.

A tube lane manipulator of the above-mentioned type is known from U.S. Pat. No. 4,079,701. In this known manipulator, a spraying lance is manually pushed through a steam generator handhole and through the tube lane and is swung back and forth by a motor. The lance is positioned in the right spraying position by observation of the nozzle jet and repositioning the lance; the water jet is atomized or scattered if the tubes are hit which is not desirable; the water jet is closed in itself if the nozzles spray into the tube lane interspaces. In this manner, the introduction of the lance, its positioning and its feed become relatively cumbersome and time-consuming. It must be noted here that operating personnel are subjected to an increased radiation dose during their stay at the handhole of the steam generator.

It is accordingly an object of the invention to provide a tube lane manipulator, spraying head and corresponding spraying method for the high-pressure blowdown of heat exchangers, which overcomes the hereinaforementioned disadvantages of the heretofore-known devices and methods of this general type, and while overcoming the difficulties described, the insertion and mounting in the operating position and the removal or disassembly of the manipulator can take place substantially more conveniently, and the positioning in the spraying position as well as the feeding can largely be done automatically, so that observation through the handhole or by means of suitable television cameras can be limited to merely control sample observations. The objectives include the creation of an advantageous spraying head for the new tube lane manipulator and a particularly advantageous spraying procedure with such a spraying head, which makes the blowdown process particularly effective.

With the foregoing and other objects in view, there is provided, in accordance with the invention, a tube lane manipulator for the high-pressure blowdown of heat exchangers, especially for the tube sheet region of steam generators of nuclear power stations, having tubes being spaced apart by a given pitch forming tube lanes therebetween with tubes on opposite sides and having closeable openings formed therein providing access to the tube lanes, comprising a car being insertible into the tube lanes through the servicing openings and being movable therein by remote control, a spraying head being supported on the car and having nozzles with orifices for spraying jets of blowdown water in a given direction into spaces between the tubes, suction lines having suction stubs for pumping off accumulated blowdown water, and extendable and retractable clamping feet disposed on the car for clamping the car to the tubes on at least one side of a tube lane along a clamping plane in conformity with the given tube pitch, the nozzles being positioned in spraying positions of a spraying position sequence by the clamping feet clamping the car, the given spraying direction from the orifices of the nozzles being adjusted to the given tube pitch and the nozzles being spaced from the clamping plane by a distance being adjusted to the given tube pitch for spraying the jets of water into the spaces between the tubes.

In accordance with another feature of the invention, the car is in the form of a stepping mechanism having at least a first and a second stepping mechanism member each being individually lockable by at least a pair of the clamping feet to the tubes on both sides of a tube lane and being movable relative to each other along a feed axis, and including at least one feed motor supported on one of the stepping mechanism members for imparting a feed movement to one of the stepping mechanism members when the clamping feet thereof are detached and the clamping feet of the the other of the stepping mechanism member are clamped and vice versa.

In accordance with a further feature of the invention, the feed motor is in the form of a stepping system having a piston connected to one of the stepping mechanism members and a cylinder connected to the other of the stepping mechanism members.

In accordance with an added feature of the invention, the piston can be acted upon from two sides thereof.

In accordance with an additional feature of the invention, the stepping system is a pneumatic piston and cylinder system.

In accordance with again another feature of the invention, there are provided pneumatic piston and cylinder systems for extending and retracting the clamping feet.

In accordance with again a further feature of the invention, the pneumatic piston and cylinder systems can be acted upon from two sides thereof.

In accordance with again an added feature of the invention, there is provided a high-pressure hose connection being disposed on the spraying head and forming a separate structural unit with the spraying head, and a fast-acting coupler for coupling the structural unit to the car.

In accordance with again an additional feature of the invention, there is provided a support body supporting the spraying head, the support body being vertically adjustable by remote control.

In accordance with yet another feature of the invention, there is provided a lifting member disposed on the car in vicinity of the spraying head, the lifting member including a vertical frame, a bearing plate disposed on the top and a bearing plate disposed on the bottom of the frame, a vertical spindle rotatably supported on the bearing plates, a travelling nut forming the support body and being vertically supported on the spindle and secured against rotation, and a rotary drive acting on an end of the spindle.

In accordance with yet a further feature of the invention, the support body includes a post and the spraying head includes a coupling hook being hung from above on the post in a coupled position, the coupling hook having an angled-off end projecting under the support body locking the spraying head in a horizontal operating position.

In accordance with yet an added feature of the invention, the lifting member has runners disposed thereon.

In accordance with yet an additional feature of the invention, the lifting member includes a coupler extension at a side of the car and the car has a coupler recess formed therein for rigidly and detachably receiving the coupler extension.

In accordance with still another feature of the invention, the coupler extension is in the form of a coupler prism having a circular segment-shaped cross-section covering substantially three-quarters of the circumference of a circle, the coupler recess has an inner cross-section being matched to the coupler prism for receiving the coupler extension from above, the coupler position being preferably secured by a ball locking mechanism, and the lifting member and car have planar contact, surfaces resting against each other.

In accordance with still a further feature of the invention, the bearing plate on the top of the vertical frame is angled-off upward and has a projecting leg, and including a miter gear disposed on an upper end of the spindle, a drive miter gear meshing with the first-mentioned miter gear, a shaft connected to the drive miter gear having an external drive coupling extension, a bearing bushing disposed on the bearing plate leg, a shaft being attached to the drive miter gear and being supported in the bearing bushing, and an elongated crank coupled to the external drive coupling extension of the drive miter gear shaft.

In accordance with still an added feature of the invention, there is provided a drive pinion disposed on the spindle, a motor coupled to the drive pinion especially through a reduction gear, and a flange connecting the motor to the bearing plate on the top of the vertical frame.

In accordance with still an additional feature of the invention, the motor is an electric d-c motor or a multiphase stepping motor.

In accordance with another feature of the invention, there are provided runners disposed on the car.

In accordance with a further feature of the invention, the spraying head includes at least three and preferably four spraying nozzle pairs disposed one behind the other in feed direction of the car, one nozzle of each pair being disposed on each respective side of the spraying head for acting on half of a tube bundle.

There is also provided a method which comprises spraying each of the at least three nozzle pairs in a respective tube lane position in a partial spraying operation, and advancing the spraying head after each partial spraying operation by at least one tube pitch for spraying at least one tube grid lane pair, separating sludge, pre-flushing and post-flushing at least one adjacent tube grid lane pair after a first and every sybsequent partial spraying operation.

In accordance with an added mode of the invention, the advancing step covers two tube pitches and the spraying step covers two tube lane pairs.

In accordance with a concomitant feature of the invention, for clamping tubes on only one side of a tube lane if the tube lanes are reduced by built-in components and/or if heat exchanger tubes are only accessible on one long side of the manipulator, at least two of the clamping feet are disposed one behind the other on one side of the car in feed direction of the car for engaging the heat exchanger tubes, and including a guide bar being disposed in the tube lane on the other side of the car, the guide bar being adjustable in alignment in the longitudinal direction of the car in the feed direction forming an abutment for the clamping feet and a guide for the car in the feed direction.

Other features which are considered as characteristic for the invention are set forth in the appended claims.

Although the invention is illustrated and described herein as embodied in a tube lane manipulator, spraying head and corresponding spraying method for the high-pressure blowdown of heat exchangers, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 2:
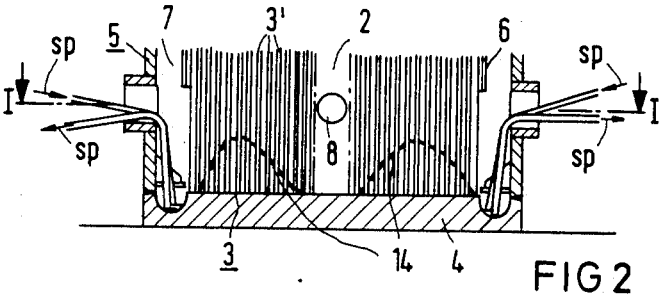
FIG. 2 is a fragmentary cross-sectional side view taken along the line II—II of FIG. 1 in the direction of the arrows, in which the steam generator portion between the tube sheet and a plane normal to the axis envisioned above the handholes is shown.
Figure 1:
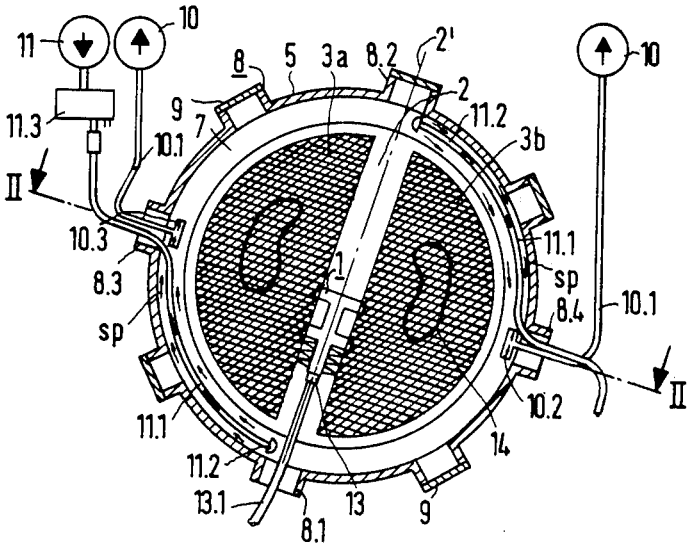
FIG. 1 is a diagrammatic, cross-sectional view taken along the line I—I of FIG. 2 in the direction of the arrows, showing a U-tube steam generator such as is used for pressurized-water nuclear power stations, with a tube lane manipulator inserted in the tube lane thereof between the two tube legs of the tube bundle.

Referring now to the figures of the drawing and first particularly to FIG. 1 thereof, it is seen that the tube lane manipulator which is designated as a whole with reference numeral 1 and is referred to hereinbelow as the manipulator for simplicity, serves for the high-pressure blowdown of heat exchangers which are provided with at least one tube lane 2 within the bundle of heat exchanging tubes. High-pressure blowdown is of particular importance for the tube sheet area of the steam generators in nuclear power stations. Such a steam generator is shown partially in FIGS. 1 and 2. The steam generation includes the above-mentioned tube lane 2 centrally disposed between two legs 3*a*, 3*b* of a U-tube bundle 3 thereof. The tube bundle 3 is set with ends of heat exchanging tubes 3' thereof in corresponding holes of a tube sheet 4 in a sealed manner, i.e. particularly welded-in. The primary plenum chambers of an inlet and an outlet chamber are to be imagined underneath the tube sheet 4. The shell of the housing of the steam generator forming a pressure vessel is designated with reference numeral 5; between it and a skirt 6 surrounding the tube bundle 3, an annular space 7 is left free. This space is normally designated as the descent space and can also serve for carrying out servicing operations, as shown in FIGS. 1 and 2. For this purpose, servicing holes which can be closed and are designated as a whole with reference numeral 8, are distributed over the circumference of the shell 5. The servicing holes 8 which are also referred to as handholes are provided with detachable handhole covers 9 which can also be replaced in a sealed manner. The two handholes 8.1 and 8.2 which are disposed diametrically opposite each other are aligned with the longitudinal axis 2' of the tube lane 2; the holes 8.1, 8.2 serve for inserting and removing the manipulator 1. Of the remaining handholes, those designated with reference numerals 8.3 and 8.4 are offset 90° relative to the handholes 8.1, 8.2; the holes 8.3, 8.4 serve for inserting suction trunks 10.2 which are mounted at the ends of suction tubes 10.1, the suction tubes 10.1 being connected to suction pumps 10. As shown in FIGS. 1 and 2, the 90°-offset handholes 8.3, 8.4 further serve for inserting so-called scrapers, which are pressure hoses 11.1 with nozzle heads 11.2 at the ends thereof that are connected to high-pressure pumps 11. Between the high-pressure pump 11 and the pressure hose 11.1 leading through the handhole 8.3, a distributor box 11.3, for instance, is further provided; for the sake of simplicity, the pump for the other pressure line 11.1 is not shown. The flow direction of the flushing liquid is indicated by arrows sp; the flushing liquid is injected into a ring zone 7 through the nozzle heads 11.2 with high pressure of 100 bar, for instance, and is then suctioned off by the suction heads or trunks 10.2 together with the desposits. The vertical spacing of the center line of the handholes 8 from the tube sheet 4 is about 250 to 300 mm. As shown in FIG. 2, the tube sheet is grooved in vicinity of the ring zone 7, so that an annular groove is formed, in which the deposits which have been torn off by the flushing process, by the manipulator 1 and also by the nozzle heads 11.2, are collected and can be suctioned off from there. The other handholes are each shown closed by a lid 9; however, if required, they can also be opened for flushing purposes and for introducing the pressure and suction hoses 11.1, 10.1.

Figure 3:
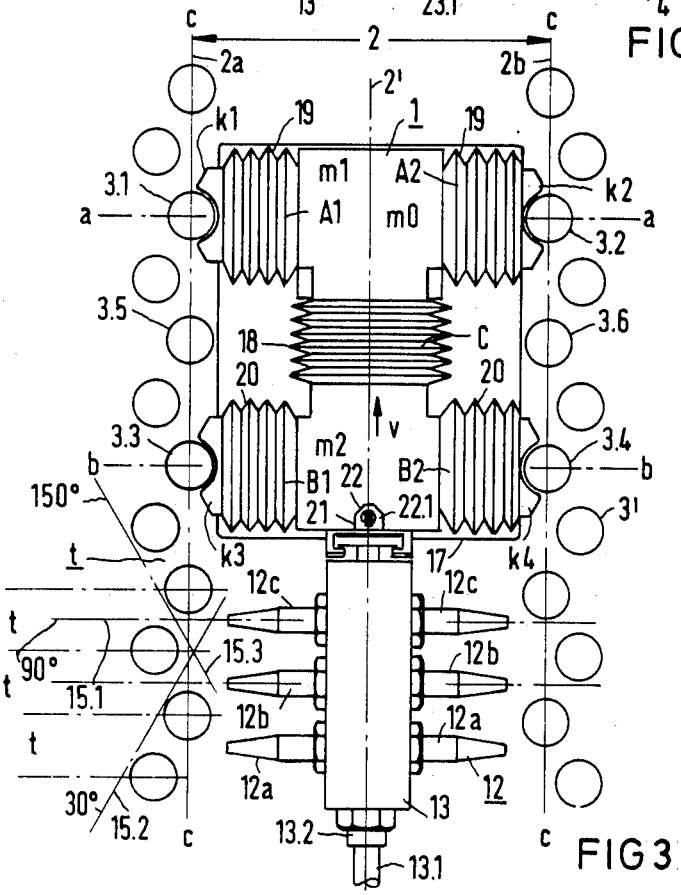
FIG. 3 is a simplified top plan view onto a tube lane manipulator according to the invention with a coupled-on six-nozzle spraying head, in which the manipulator is clamped to opposite tubes of the tube lane.

According to FIG. 1, a spraying head 13 of the manipulator 1, equipped with nozzles 12 shown in FIG. 3, is inserted into the tube lane 2 and can be moved and positioned in this tube lane 2 along the longitudinal axis 2' of the tube lane in such a manner that the spray jets of the spraying head 13 are directed into the tube grid interspaces, which may also be referred to as tube grid lanes. Approximately kidney-shaped lines 14 in FIG. 1 (see also the contour 14 in FIG. 2), indicate the location of slush accumulations which are removed and finally eliminated by the spraying process by means of the manipulator 1. The blowdown water which is accumulated in the process and contains the torn-away deposits is transported through the tube grid lanes 15 seen in FIG. 5 and through the tube lane 2 to the outer periphery, i.e. into the ring zone 7 from where it is suctioned off by means of the suction heads 10.2. The spraying pressure for the spraying head 13 which is connected to a high-pressure hose 13.1, is about 220 bar. The spraying water which is used is so-called deionate, which is chemically processed water, the conductivity of which is less than 100 μS and the pH value of which must be within the limits of 5 and 10. The deionate is taken from a supply tank of about 3 $m^3$ volume. The water sprayed into the steam generator is then pumped off and returned to the supply tank through a filter unit. The circulating deionate is continuously monitored during the cleaning process for its pH value and the conductivity and is renewed when the above-mentioned limits are no longer maintained. The external water loop with the supply tank, pumps, filters and monitoring devices is not shown because it is not necessary for an understanding of the invention.

Figure 4:
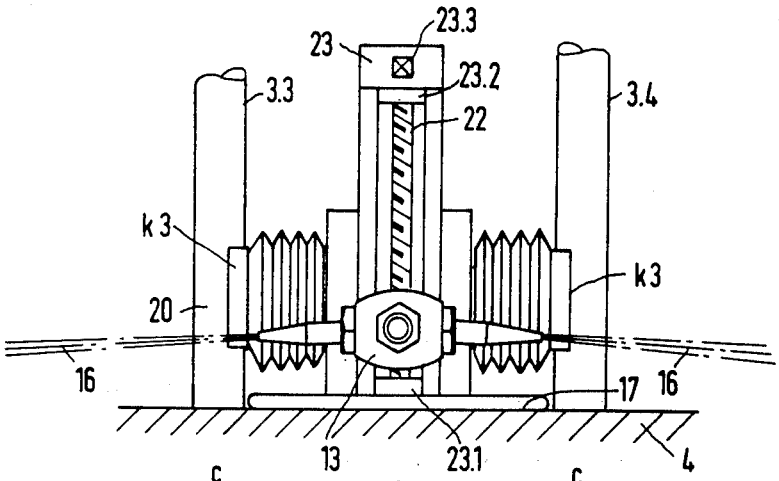
FIG. 4 is a top plan view of the device according to FIG. 2, as seen toward the spraying head end face.

FIGS. 3 and 4 show in greater detail that the spraying head 13 is supported by a car or vehicle m0 of the manipulator 1 which can be inserted into the tube lane 2 through a servicing opening (such as a handhole 8.1 shown in FIG. 1) and can be moved therein by remote control. The respective spraying position of the nozzles 12 of the spraying head 13 can be moved over a spraying position sequence, extending over the entire length of the tube lane, by the provision of clamping the car m0, conforming to the tube pitch, by means of clamping feet k1, k2 and k3, k4 which can be run in and out. The car m0 is clamped to the tubes 3' of the two opposite tube lane sides 2*a*, 2*b*. In the case shown, the manipulator with its car m0 and its spraying head 13 is in the spraying position, i.e. the clamping feet k1, k2 in the clamping plane a—a as well as the clamping feet k3, k4 in the clamping plane b—b are in the extended, clamped position, in which they rest against the tube 3' with concave clamping surfaces which are fitted to the tube contour; in the case shown, these are the tubes 3.1, 3.2, 3.3 and 3.4.

Figure 5:
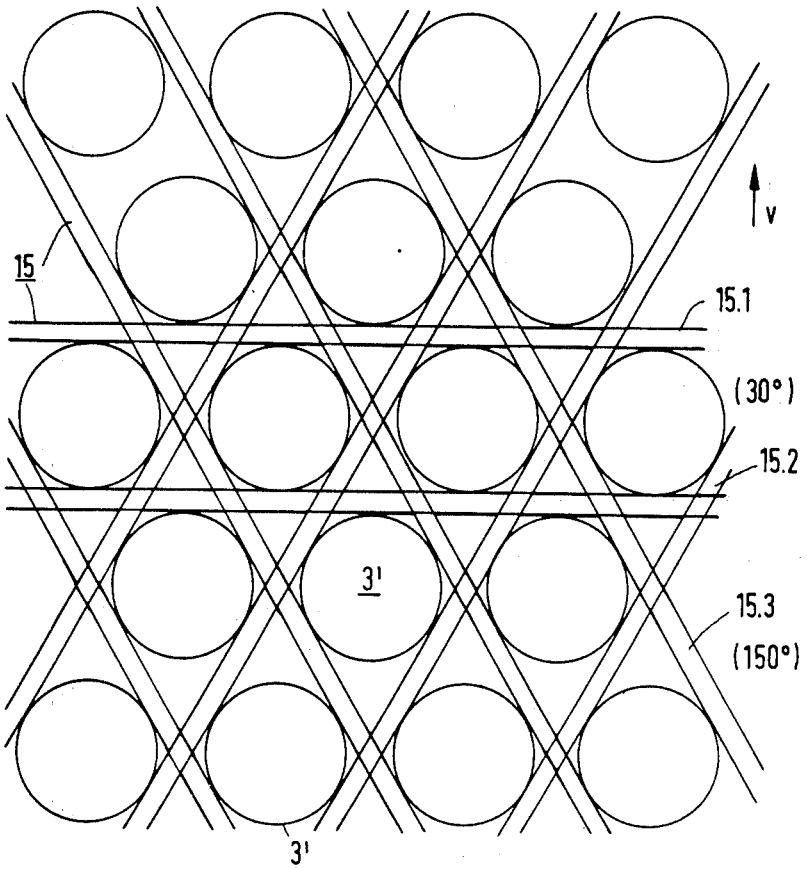
FIG. 5 is an elevational view of a segment of a tube grid illustrating that in the steam generator shown in FIGS. 1 and 2, tube grid lanes are provided which extend at an angle of 30°, 90°, and 150° to the longitudinal axis of the tube lane.

By comparing FIG. 3 with FIG. 5, it is seen that in the tube grid configuation shown, three kinds of tube grid lanes can be distinguished: 90° lanes 15.1, 30° lanes 15.2 and 150° lanes 15.3. The manipulator 1 must be in the position to spray with its spraying jets through all of these different types of lanes, for which purpose difeferent spraying heads with correspondingly oriented spraying nozzles are provided. In FIG. 3, a 90° spraying head is shown, i.e. its nozzles 12 are at right angles to the longitudinal axis 2' of the tube lane, or the feed axis of the manipulator 1, so that the tube grid lanes 15.1 can be sprayed with these nozzles. The individual nozzle pairs are specifically given reference symbols 12*a*, 12*b*, 12*c*. The direction of the mouth of the spraying nozzles 12 as well as the distance thereof from the clamping planes b—b and a—a, respectively, of the clamping feet k are matched to the tube pitch or spacing t in such a way that jets 16 seen in FIG. 4 in any event reach into the tube grid lanes 15 seen in FIG. 5 or specifically into the tube grid lanes 15.1 shown in FIG. 3. If reference symbol t is understood to mean the distance between two adjacent heat exchanger tubes in the longitudinal direction of the tube lanes, then also the mouths of the nozzles 12 are disposed at the same distance from each other, i.e. the nozzle pair 12*a* from 12*b*; 12*b* from 2*c*; and the distance from the mouth of the nozzle 12 to the clamping planes b—b or a—a, respectively, is t (n+½) where n=1, 2, 3 . . . . This formula logically also applies to spraying heads, the nozzles of which do not spray at right angles, but, for instance, at an angle of 30° or 150° relative to the longitudinal direction of the tube lanes into the tube grid lanes, if the intersection of the nozzle axis with the line c—c connecting the tubes, which extends parallel to the axis of the tube lane direction 2' is considered as the distance criteria. For example, in this case, the nozzle jet is always oriented toward the center of the tube grid lanes 15, as seen in FIG. 5.

FIGS. 3 and 4 and to an even greater extend FIGS. 6 to 7 which will be explained later show more clearly that the car m0 is a stepping mechanism which can be moved along a feed axis v which coincides with the central axis 2' of the tube lane 2. For this purpose, the car m0 includes at least two stepping mechanism members m1, m2 which can be moved relative to each other in the feed axis v and which can also be referred to as a first and a second stepping mechanism member. Each of the stepping mechanism members m1, m2 can be locked by means of at least one pair of clamping feet k1, k2 and k3, k4, respectively, to the tubes 3' located on both sides of the tube lane 2. In the position shown, the stepping mechanism member m1 with its clamping feet k1, k2 is locked to the mutually opposite tubes 3.1, 3.2, and the stepping mechanism member m2 is locked with its clamping feet k3, k4 to the mutually opposite tubes 3.3, 3.4. The bottom of one of the two stepping mechanism members m1, m2 is connected to the guide plate 17, which allows the car m0 to slide along the tube sheet 4. In the embodiment example shown, this is the second stepping mechanism member m2. Supported on the second stepping mechanism member m2 is also a feed motor which is generally designated with reference symbol C and a movable drive member thereof which is disposed within a sealing sleeve 18 and is connected to the first stepping mechanism member m1. This may also be an electric motor with reduction gearing which, for instance, turns a spindle having a travelling nut that is axially movably supported on the spindle but secured against rotation and is connected to the first stepping mechanism member. However, these may also be hydraulic or pneumatic piston-cylinder systems. This logically also applies to positioning members B1, B2 of the clamping feet k3, k4 and positioning members A1, A2 of the clamping feet k1, k2, which are likewise surrounded by respective sealing sleeves 19 and 20, respectively. It is particularly advantageous to use pneumatic piston-cylinder systems and specifically those which can be acted upon from both sides, as will be explained later on herein.

For an understanding of the stepping process, it will be assumed that the clamping feet k1, k2 are engaged as shown, but the clamping feet k3, k4 are withdrawn or disengaged. The feed motor C is then acted upon in such a manner that the stepping mechanism member m2 is pulled along through a distance of two tube pitches t in the feed direction v. The stepping mechanism member m2 is then locked with its positioning members B1, B2 at the tubes 3.5, 3.6. Now the clamping feet k1, k2 can be detached and by action of the feed motor C, the first stepping mechanism member m1 is advanced in the feed direction v again through two tube pitches t, and locked after the feed. This would be the new spraying position, in which the two spraying nozzles **12*a* can spray into those tube grid lanes which had been acted upon in the preceding position by the spraying nozzles 12*c*', while the spraying nozzles 12*b*' and 12*c*'** spray into new tube grid lanes.

FIGS. 3 and 4 further show that the spraying head 13 with its high-pressure hose connection 13.2 forms a separate structural unit, which can be coupled to the car m0 by means of a fast-acting coupler 21.

This coupler is indirect since the spraying head 13 is connected to a travelling nut 22.1 which is supported in such a way as to be secured against rotation, but adjustable in length and height on a vertical screw spindle 22 of a lifting member 23, as seen in particular in FIG. 4. The lifting member 23 includes a vertical frame with bearing plates 23.1, 23.2 on the bottom and top, the already mentioned vertical screw spindle 22 supported in the bearing plates, the likewise already mentioned travelling nut 22.1 which is supported on the spindle so as to be secured against rotation and adjustable in height as the support body of the spraying head, and a rotary drive which is associated with one of the spindle ends. In the present case the rotary drive is associated with the upper spindle end. Of these, only the coupler stub 23.3 for coupling to a drive shaft is visible in FIG. 4. The fast-acting coupler 21 as well as the lifting member 23 are only shown in FIGS. 3, 4 in a simplified and diagrammatic manner, they will likewise be described in greater detail by making reference to FIGS. 6 to 8. The lifting member 23 has the particular advantage that at the start of the spraying process, the spraying head 13 can begin with the spraying process at first in a position which is not the lower position shown in FIG. 1, but a higher position because generally (see the sludge accumulation contours in FIGS. 1 and 2) amounts of sludge of larger or smaller size have accumulated between the inspection cycles and these are best removed from the top down. Therefore, the tube lane 2 is traversed by the manipulator 1 in such a way that the sludge accumulations are removed or flushed out from the top down, where successively with each traversing of the tube lane, the spraying head 13 is moved down through a distance with its lifting member 23. FIGS. 6 to 8 show structural details of the manipulator with its spraying head; parts which are like those in the previous figures carry the same reference symbols. FIG. 7 shows the feed motor C, in the form of a stepping piston/cylinder system which can be acted upon from both sides, a stepping cylinder c2 being connected to the second stepping mechanism member m2 and a stepping piston c1 being connected to the first stepping mechanism member m1. The first stepping mechanism member m1 is substantially in the form of a cylinder block which comprises the cylinder bores of the two clamping piston/cylinder systems A1, A2 shown in FIG. 6 and the bores for the piston guide rods, disposed on a rectangle. The piston guide rods are designated with reference symbol a4; the cylinder bore is designated with reference symbol a3. The second stepping mechanism member m2 is also substantially in the form of a cylinder block which contains not only a cylinder bore c3 for the stepping piston c1 which is oriented in the feed direction v, but also the cylinder bore b3 oriented transversely thereto, for the two clamping pistons of the clamping piston/cylinder system B1, B2 of the clamping plane b—b. In this case as well, four bore holes b4, disposed along a rectangle, are provided for receiving the corresponding clamping piston guide rods. On the bottom and top of the second stepping mechanism member m2 are milled-in substantially T-shaped guide slots 24 and 25, also seen in FIG. 8, at which the first stepping mechanism member m1 is guided with a double-T-shaped guide bar 24*a* and 25*a* on the top and bottom of a corresponding cross section so as to be movable longitudinally. The guide bars 24*a*, 25*a* are connected to the cylinder block of the first stepping mechanism member by means of cylinder-head screws, particularly socket-head cap screws. A piston rod c11 of the stepping piston c1 is screwed into a corresponding tapped hole 27 of the last-mentioned cylinder block. A piston disc c12 of the rod c11 can be moved back and forth within the cylinder bore c3, so that it can be acted upon from two sides. A disc-shaped cylinder head seal through which the piston rod c11 passes centrally, is designated with reference symbol c4; a piston ring seated in a circular slot of the disc c12 is designated with reference symbol c5; and the other ring seals in the cylinder head seal c4 are designated with reference symbols c41.

Figure 6:
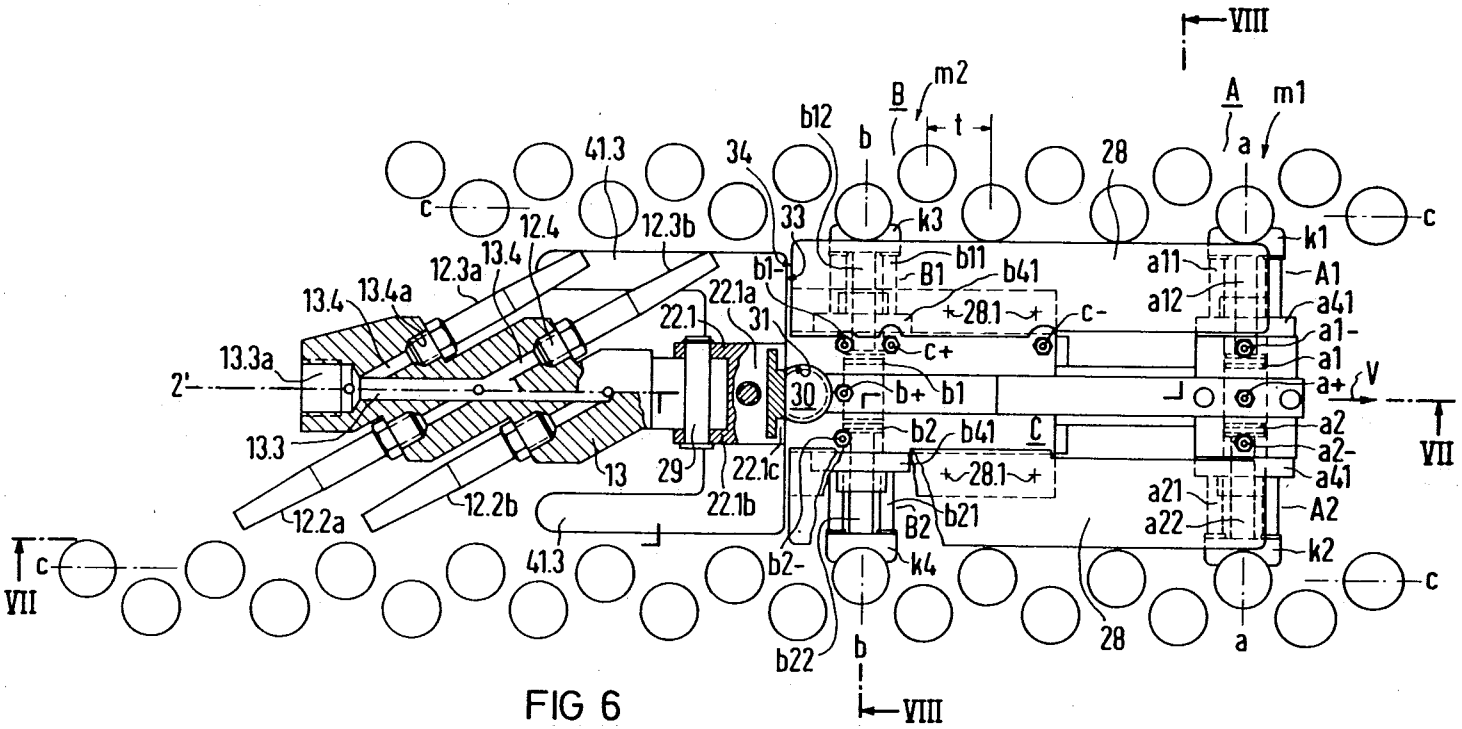
FIG. 6 is a top plan view corresponding to FIG. 3, but in greater detail and with a modified spraying head (30° and 150° nozzles instead of 90° nozzles), the manipulator being shown partly in a side view and partly in cross section along the line VI—VI of FIG. 7 in the direction of the arrows.

Clamping pistons a1, a2 and b1, b2 are indicated by broken lines in FIG. 6; the corresponding piston guide rods are designated with reference symbols a11, a21, b11 and b21. These guide rods, like piston rods a12, a22, b12, b22 are connected at their outer ends to the support feet k1 to k4; the support feet have an approximately saddle-shaped contour to fit the heat exchanger rubes. The disc-shaped cylinder head seals for sealing the cylinder chambers and the piston rod feedthrough are generally designated with reference symbols a41 and b41, respectively.

FIG. 8 shows the two clamping piston/cylinder systems B1 and B2 in a cross section and an elevational view. Details of the clamping piston structure with the piston ring b5 in a corresponding piston ring slot and the ring seals b42 at the cylinder head seal b41 are seen therein. It may further be seen from the clamping feet k4 that the clamping feet are tightened at the piston rods of the clamping piston by means of strong countersunk screws 270. The compressed-air connections for the stepping piston c1 are designated with reference symbols c+ and c−, where the plus sign symbolizes that the corresponding compressed-air connection serves for running-out the piston; and the minus sign correspondingly symbolizes a compressed-air connection, which upon activation runs-out the piston. This kind of designation is also similarly used for the clamping pistons, the common compressed-air connections of which that serve for running-out are designated with reference symbols a+ and b+, respectively, and the compressed-air connections of which associated with each individual clamping piston that serve for running-in are designated with reference symbols a1−, a2−, b1− and b2−. The compressed-air connections are formed of nipples which are suited for fact-action coupling and decoupling of the compressed-air lines. The guide plate 17, already mentioned in connection with FIG. 4, is fastened to the bottom of the second stepping mechanism member m2; it may also be constructed as a runner. The first stepping mechanism member m1 is also provided on the bottom thereof with a guide plate 17.1 at the same height as the guide plate 17, or with corresponding runners. These guide plates or runners 17, 17.1 are advantageously formed of a wear-resistant plastic, as are guide strips 28 which are provided at the top on both long sides of the car m0 and are bolted at locations 28.1 to the cylinder block of the second stepping mechanism member m2. The guide strips serve for the additional guidance of the car m0 at the two rows of tubes c—c immediately adjacent the tube lane, and can be exchanged for other suitable guide strips, depending on the width of the tube lane of the steam generator to be cleaned.

FIG. 6 shows that the spraying head 13 is formed of a solid spraying head housing with a central hole 13.3, from which branch holes 13.4 start and lead to individual spraying nozzles 12.3*a*, 12.3*b* in the upper half of FIG. 6, and 12.2*a*, 12.2*b* in the lower half of FIG. 6. A tapped hole 13.3*a* is formed at the outer end of the central hole 13.3 for connecting the pressurized-water hose. Corresponding tapped holes 13.4*a* are provided at the respective outer ends of the branch canals or holes 13.4, into which the spraying nozzles with corresponding threaded necks 12.4 can be tightly screwed. The upper nozzles 12.3*a*, 12.3*b* serve for spraying to loosen 150°-grid tube lanes 15.3 shown in FIG. 5; the nozzles belong to a four-nozzle spraying head, however, a six-nozzle or eight-nozzle spraying head naturally could also be provided according to FIG. 3. The number of nozzles is limited by the output of the high-pressure pumps; for a high-pressure pump of 240 kW, a spraying head with eight nozzles is the upper limit, i.e., no appreciable pressure drop takes place as yet. In the lower half of FIG. 6, a spraying head with the spraying nozzles 12.2*a*, 12.2*b* is shown which belongs to a four-nozzle spraying head and serves for spraying-loose tube grid lanes 15.2 seen in FIG. 5, which form an angle of 30° with the feed direction v or the longitudinal direction of the tube lane. The spraying head could also have six or eight nozzles.

Figure 7:
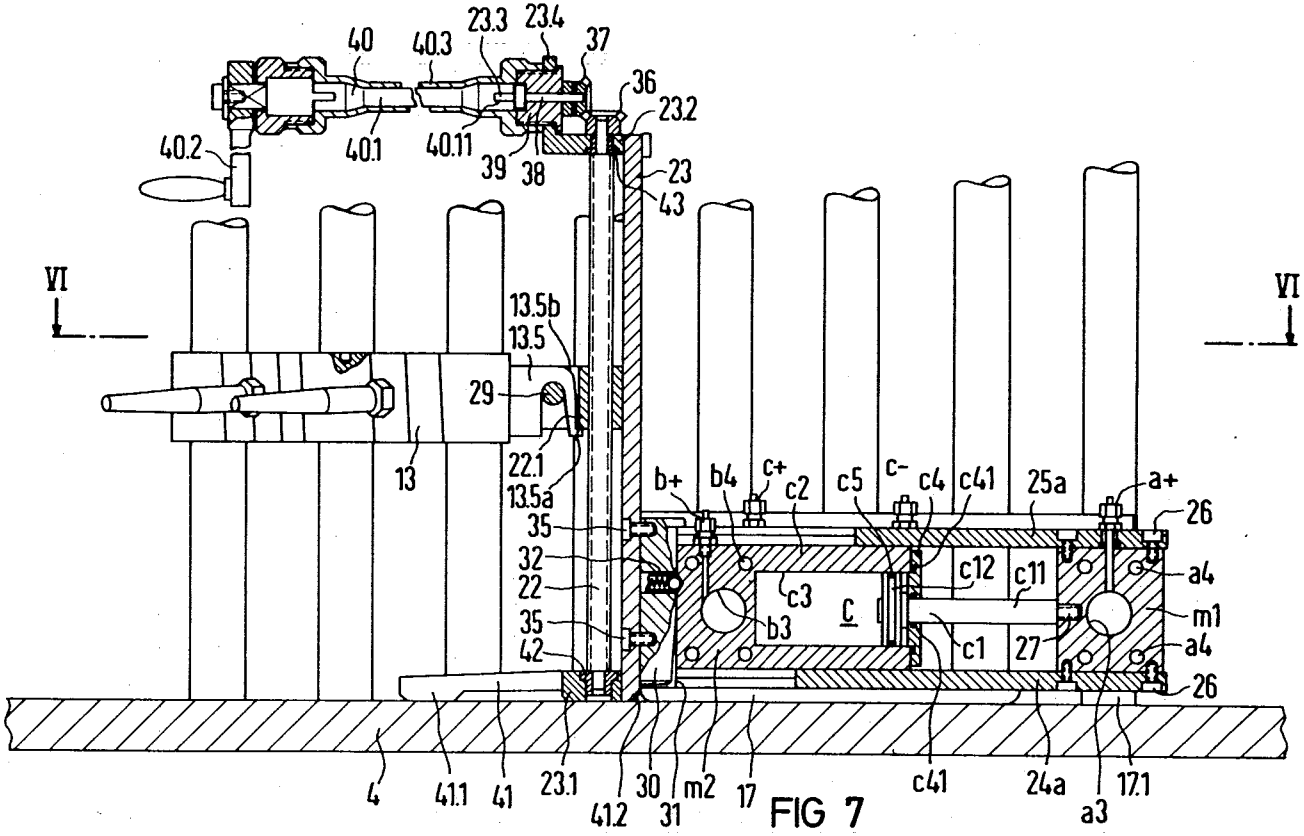
FIG. 7 is likewise a partially elevational and partially cross-sectional view taken along the line VII—VII of FIG. 6 in the direction of the arrows, showing the manipulator with the spraying head.
Figure 8:
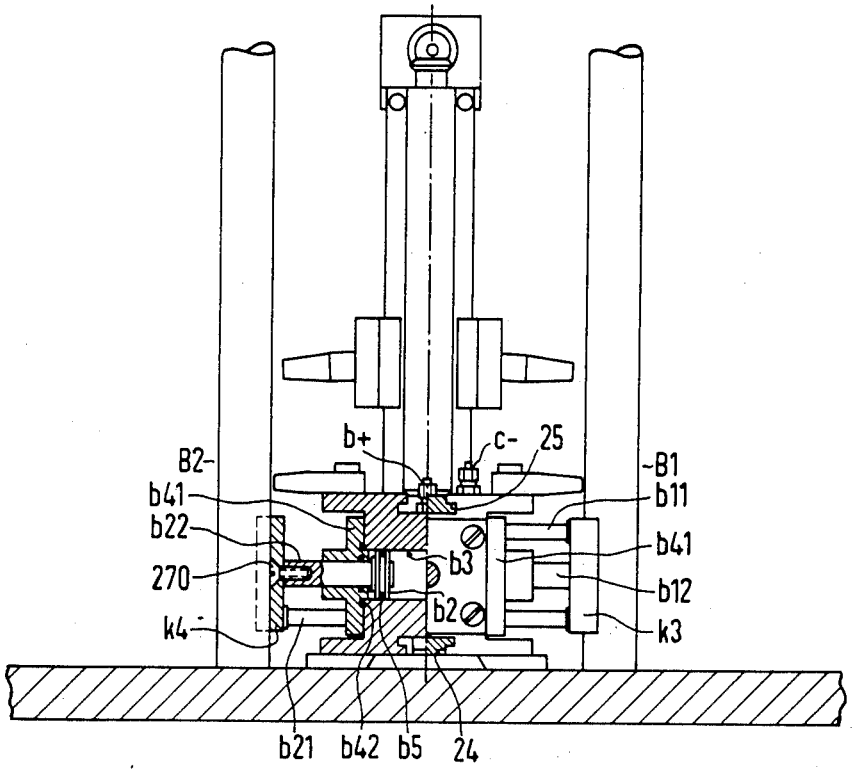
FIG. 8 is a fragmentary, partially side elevational and partially cross-sectional view taken along the line VIII—VIII of FIG. 6, in the direction of the arrows.

In order to allow the different spraying heads according to FIGS. 3 and 6 to be interchanged quickly, they can be coupled to or decoupled from the support of the lifting member 23, constructed as a travelling nut 22.1, for which purpose the spraying head 13 can be hung from a post 29 of the support body 22.1 from above, with a coupling hook 13.5 shown in FIG. 7. In the coupling position shown, an angled-off end 13.5*a* of the coupling hook 13.5 extends under the support body 22.1 and thus locks the spraying head 13 in the horizontal operating position. This fact-acting coupling point between the elements 13.5 and 29 simultaneously forms a joint, at which the spraying head can be swung clockwise upward about the post 29 if it is to be decoupled, and counterclockwise if it is to be coupled. For this purpose, a rounded turning edge 13.5*b* is provided.

The lifting member 23 in turn is connected to the car m0 by means of a fast-action coupler. To this end, the lfting member is provided on its side facing the car with a coupler extension 30, and the car m0 is provided on its rear face with a corresponding coupling recess 31. As seen in FIG. 6, the coupler extension 30 is a coupling prism having a cross section of a circular segment which covers about ¾ of the circumference of a circle; the coupler extension 30 can be inserted into the coupler recess 31 which has a corresponding clear cross section from above. The coupler position is defined and secured by a ball locking mechanism 32. In the coupler position shown, the lifting member 23 and the car m0 further rest with plane contact surfaces 33 against plane countersurfaces 34, so that the alignment of the spraying head 13 with its longitudinal axis in the feed direction v is thereby assured. The coupler extension 30 is clamped by means of cylinderhead screws 35 to the vertical frame of the lifting member 23.

In addition, details of the lifting member may be seen from FIG. 7. A bearing plate 23.2 on the top of the lifting member 23 is angled-off upward and thus forms a bearing leg 23.4. The upper end of the spindle 22 meshes through a miter gear 36 with a drive miter gear 37, the shaft 38 of which is supported in a bearing bushing 39 of the vertical plate or bearing leg 23.4. An elongated drive crank 40 can be coupled to an outer driving coupler extension 23.3 of the driving-miter gear shaft 38. The crank 40 includes a crank shaft 40.1 proper with a crank 40.2 and a shaft housing 40.3. The shaft housing 40.3 can be placed on the bearing sleeve 39 with a cup-shaped extension, centering the same; the shaft 40.1 being coupled to a corresponding coupling recess 40.11 by the blade-shaped coupler extension 23.3. Instead of the manually operated drive crank shown, it would also be possible to connect a drive motor to the top of the bearing plate 23.2 with a flange. The drive motor can be coupled especially through a reduction gear, to a non-illustrated driving pinion of the spindle 22. Suitable drive motors for such a remotely controlled rotation of the threaded spindle 22, may be electric d-c or multi-phase stepping motors.

The bottom of a bearing plate 23.1 is connected to a runner 41 or is made as one piece therewith. The runner 41 has four base parts 41.1 and 41.2 at two fork-like extensions 41.3 sliding on the tube sheet shown in FIG. 6. The screw spindle 22 is rotatably supported at both ends thereof in bearing bushings 42, 43, which are inserted into corresponding recesses of the plates 23.1, 23.2 on the bottom and top. As seen in FIG. 6, the support body 22.1 is formed of the travelling-nut part 22.1*a* with an internal thread, a fork part 22.1*b* for holding the coupler post 29 and for locking the coupling hook 13.5, and a guide part 22.1*c* with a substantially T-shaped recess which is defined by the vertical frame 23 of the lifting member and is longitudinally movably guided thereon and secured against rotation.

The spraying and cleaning process becomes particularly effective with the manipulator 1 described, if a spraying head is used which has at least three pairs of spraying nozzles located one behind the other in the feed direction v, where the spraying nozzles of each pair of spraying nozzles are each disposed on opposite sides of half a tube bundle for acting on one tube bundle half each. This is shown in principle in FIG. 3 through the example of the spraying head 13 and has been explained with reference to the spraying head 13 of FIG. 6 (the spraying head structures of the upper and lower half of FIG. 6 should be considered as supplemented by at least one further pair of spraying nozzles). With such a spraying head, a spraying method can then be carried out, in which the spraying head is advanced after each partial spraying operation, in which all, or at least three, nozzle pairs spray in the respective tube lane position, over at least one tube pitch and preferably two tube pitches. In this way, after the first and every subsequent partial spraying operation, at least one pair of tube grid lane pairs and preferably two tube grid lane pairs is sprayed, loosened and pre-flushed, and correspondingly, at least one adjacent pair of tube grid lanes is sprayed in a post-flushing action. This method can be carried out most advantageously with an eight-nozzle spraying head which thus has four spray nozzle pairs. This is because in such a case two tube grid lane pairs can always be sprayed for slush separation and with pre-flushing, and the adjacent two tube grid lane pairs can be sprayed for after-flushing, and the feed of the manipulator or spraying head between the partial spraying operations is two tube pitches. This feed over two tube pitches is also made the basis of the manipulator shown in FIG. 3 and FIGS. 6 to 8, because the spacing of the heat exchanger tubes in the feed direction v of the two rows of tubes next to the tube lanes, atainst which the manipulator is clamped, always amounts to two tube pitches ($2\times t$). In principle, it would also be possible to perform a feed of only a tube pitch t, if the support feet k are so narrow that they reach between the tubes of the row of tubes next to the tube lane, and can clamp themselves to the tubes of the second rows of tube lanes. The piston stroke for the clamping piston systems A and B must then also be increased slightly.

The manipulator 1, i.e., its car m0, can additionally also be equipped with lighting devices such as spotlights, and with television cameras, so that the progress of the spraying and flushing process can be observed on a monitor by remote control. The special advantage of the manipulator is its easy handling: The car m0 can be brought conveniently into its starting position through the open handhole and can be coupled to the lifting device and the spraying head. The stroke of the stepping piston c1 and the stepping piston system C is adjusted to exactly two tube pitches. In this manner, it can advance, in an intrinsically safe manner, along the tube lane without complicated control mechanisms and can center itself at the heat-exchanging tubes. In this connection, locking is advantageous so that action on the spraying nozzles is permitted only if the car m0 is clamped by all four clamping feet. The pneumatic control is very rugged. The backing-up motion also takes place in just the same manner as the manipulator is moved in the feed direction v. Reversing the car at the end of the tube lane is generally not necessary since the last tube grid lanes exhibit no sludge accumulations. In principle, it would be possible, however, to provide both end faces of the car with a spraying head, either for acting on both spraying heads alternatingly or for simultaneous action for intensifying the spraying and flushing process. Since practically all operations can be performed by remote control, remarkable savings of rems per man are obtained.

There may also be cases where only one of the two opposite longitudinal sides of the tube lane of a heat exchanger or steam generator is available for tube-clamping feet, such as if the width of the tube lane is reduced by built-in components. In this case, provision is made according to the invention that on one side of the car m0 at least two clamping feet k are disposed one behind the other. The feet are movable in the feed direction v of the car, for engaging the heat exchanger tubes, but on the other longitudinal side of the car, a guide bar can be installed within the tube lane which is aligned in the lengthwise direction thereof or in the feed direction, and forms the abutment for the clamping feet k and a guide for the car m0 in the feed direction v. This embodiment is not shown in the drawing but is understandable without difficulty if, in FIG. 3, one imagines that instead of the one row of tubes c—c, a guide bar is provided which guides or contains suitable guide prisms, for instance, in a longitudinal slot. The guide prisms are mounted at the car m0, for instance, in place of the extendable clamping feet k1, k3. In this case, too, a feed of the car m0 and the manipulator 1, respectively, can be obtained which is in conformance with the tube pitch.

We claim:

1. Tube lane manipulator for the high-pressure blowdown of heat exchangers having tubes being spaced apart by a given pitch forming tube lanes therebetween with tubes on opposite sides and having closeable servicing openings formed therein providing access to the tube lanes, comprising a car being insertible into the tube lanes through the servicing openings and being movable therein by remote control, a spraying head being supported on said car and having nozzles with orifices for spraying jets of blowdown water in a given direction into spaces between the tubes, suction lines having suction stubs for pumping off accumulated blowdown water, and extendible and retractible clamping feet disposed on said car for clamping said car to the tubes on at least one side of a tube lane along a clamping plane in conformity with the given tube pitch, said nozzles being positioned in spraying positions of a spraying position sequence by said clamping feet clamping said car, said given spraying direction from said orifices of said nozzles being adjusted to the given tube pitch and said nozzles being spaced from said clamping plane by a distance being adjusted to the given tube pitch for spraying the jets of water into the spaces between the tubes.

2. Tube lane manipulator according to claim 1, wherein said car is in the form of a stepping mechanism having at least a first and a second stepping mechanism member each being individually lockable by at least a pair of said clamping feet to the tubes on both sides of a tube lane and being movable relative to each other along a feed axis, and including at least one feed motor supported on one of said stepping mechanism members for imparting a feed movement to one of said stepping mechanism members when said clamping feet thereof are detached and said clamping feet of the other of said stepping mechanism members are clamped.

3. Tube lane manipulator according to claim 2, wherein said feed motor is in the form of a stepping system having a piston connected to one of said stepping mechanism members and a cylinder connected to the other of said stepping mechanism members.

4. Tube lane manipulator according to claim 3, wherein said piston can be acted upon from two sides thereof.

5. Tube manipulator according to claim 3, wherein said stepping system is a pneumatic piston and cylinder system.

6. Tube lane manipulator according to claim 1, including pneumatic piston and cylinder systems for extending and retracting said clamping feet.

7. Tube lane manipulator according to claim 6, wherein said pneumatic piston and cylinder systems can be acted upon from two sides thereof.

8. Tube lane manipulator according to claim 1, including a high-pressure hose connection being disposed on said spraying head and forming a separate structural unit with said spraying head, and a fast-acting coupler for coupling said structural unit to said car.

9. Tube lane manipulator according to claim 8, including a support body supporting said spraying head, said support body being vertically adjustable by remote control.

10. Tube manipulator according to claim 9, including a lifting member disposed on said car in vicinity of said spraying head, said lifting member including a vertical frame, a bearing plate disposed on the top and a bearing plate disposed on the bottom of said frame, a vertical spindle rotatably supported on said bearing plates, a traveling nut forming said support body and being vertically supported on said spindle and secured against rotation, and a rotary drive acting on an end of said spindle.

11. Tube manipulator according to claim 10, wherein said support body includes a post and said spraying head includes a coupling hook being hung from above on said post in a coupled position, said coupling hook having an angled-off end projecting under said support body locking said spraying head in a horizontal operating position.

12. Tube lane manipulator according to claim 1, including a support body supporting said spraying head, said support body being vertically adjustable by remote control.

13. Tube manipulator according to claim 12, including a lifting member disposed on said car in vicinity of said spraying head, said lifting member including a vertical frame, a bearing plate disposed on the top and a bearing plate disposed on the bottom of said frame, a vertical spindle rotatably supported on said bearing plates, a traveling nut forming said support body and being vertically supported on said spindle and secured against rotation, and a rotary drive acting on an end of said spindle.

14. Tube lane manipulator according to claim 13, wherein said lifting member has runners disposed thereon.

15. Tube lane manipulator according to claim 13, wherein said lifting member includes a coupler extension at a side of said car and said car has a coupler recess formed therein for rigidly and detachably receiving said coupler extension.

16. Tube lane manipulator according to claim 15, wherein said coupler extension is in the form of a coupler prism having a circular segment-shaped cross-section covering substantially three-quarters of the circumference of a circle, said coupler recess has an inner cross-section being matched to said coupler prism for receiving said coupler extension from above, and said lifting member and car have planar contact surfaces resting against each other.

17. Tube manipulator according to claim 13, wherein said bearing plate on the top of said vertical frame is angled-off upward and has a projecting leg, and including a miter gear disposed on an upper end of said spindle, a drive miter gear meshing with said first-mentioned miter gear, a shaft connected to said drive miter gear having an external drive coupling extension, a bearing busing disposed on said bearing plate leg, a shaft being attached to said drive miter gear and being supported in said bearing bushing, and an elongated crank coupled to said external drive coupling extension of said drive miter gear shaft.

18. Tube lane manipulator according to claim 13, including a drive pinion disposed on said spindle, a motor coupled to said drive pinion, and a flange connecting said motor to said bearing plate on the top of said vertical frame.

19. Tube manipulator according to claim 18, wherein said motor is an electric d-c motor.

20. Tube manipulator according to claim 18, wherein said motor is a multi-phase stepping motor.

21. Tube manipulator according to claim 1, including runners disposed on said car.

22. Tube manipulator according to claim 1, wherein said spraying head includes at least three spraying nozzle pairs disposed one behind the other in feed direction of said car, one nozzle of each pair being disposed on each respective side of said spraying head for acting on half of a tube bundle.

23. Tube manipulator according to claim 1, for clamping tubes on only one side of the tube lane, wherein at least two of said clamping feet are disposed on behind the other on one side of said car in feed direction of said car for engaging the tubes, and including a guide bar being disposed in the tube lane on the other side of said car, said guide bar being adjustable in alignment in one of the longitudinal direction of said car and said feed direction forming an abutment for said clamping feet and a guide for said car in said feed direction.

* * * * *